US010932596B2

(12) United States Patent
Phan

(10) Patent No.: US 10,932,596 B2
(45) Date of Patent: Mar. 2, 2021

(54) DUVET COVER-DEVICES AND METHODS OF USE

(71) Applicant: Lisa Phan, Oakland, CA (US)

(72) Inventor: Lisa Phan, Oakland, CA (US)

( * ) Notice: Subject to any disclaimer, the term of this patent is extended or adjusted under 35 U.S.C. 154(b) by 177 days.

(21) Appl. No.: 15/878,602

(22) Filed: Jan. 24, 2018

(65) Prior Publication Data

US 2019/0223630 A1 Jul. 25, 2019

(51) Int. Cl.
*A47G 9/02* (2006.01)

(52) U.S. Cl.
CPC .... *A47G 9/0261* (2013.01); *A47G 2009/0269* (2013.01)

(58) Field of Classification Search
CPC ..... A47G 9/0207; A47G 9/02; A47G 9/08; A47G 9/0284; A47G 9/0261; A47G 2009/0269
See application file for complete search history.

(56) References Cited

U.S. PATENT DOCUMENTS

| | | | | |
|---|---|---|---|---|
| 3,501,787 | A | 8/1967 | Nunn | |
| 7,181,790 | B2 | 2/2007 | Writz | |
| 7,249,389 | B2 | 7/2007 | Russell | |
| 7,624,460 | B2 | 12/2009 | Maimone et al. | |
| 2005/0144712 | A1 | 7/2005 | Linnane | |
| 2012/0260425 | A1 | 10/2012 | Pecqueur | |
| 2013/0152306 | A1 * | 6/2013 | Monaco | A47G 9/04 5/498 |
| 2016/0242559 | A1 * | 8/2016 | Hui | A47C 21/022 |

FOREIGN PATENT DOCUMENTS

| | | | | |
|---|---|---|---|---|
| GB | 2312164 | A | 10/1997 | |
| GB | 2318051 | A * | 4/1998 | A47G 9/0261 |
| GB | 2321851 | A | 8/1998 | |
| GB | 2363531 | A | 10/1999 | |
| GB | 2366724 | A | 3/2002 | |

* cited by examiner

*Primary Examiner* — David R Hare
*Assistant Examiner* — Adam C Ortiz

(57) ABSTRACT

Devices and methods that allow for rapid and efficient changing of duvet covers, comprising an upper section and a lower section of washable material that are sized to be significantly larger than a duvet that will be covered and isolated. The upper and lower sections are secured together along a single edge only, and that edge is positioned at the head of the bed. The duvet is placed between the upper and lower sections, isolating and enclosing the duvet, thereby preventing the duvet from becoming exposed while the bed is in use, and simultaneously allowing for easy and rapid changing of the duvet cover after use.

3 Claims, 4 Drawing Sheets

DUVET COVER-DEVICES AND METHODS OF USE

BACKGROUND

This present invention relates to devices and methods for efficiently isolating or covering a duvet, and making a bed.

Hotels, motels, and inns have many guests that stay overnight, and sleep in beds provided by these establishments (hereafter collectively "hotel" or "hotels"). Hotel personnel change the bed sheets after guests depart but often do not change the duvet. Many guests do not want to be exposed to an unwashed duvet that had been used by other people.

Some hotels use systems and devices to cover a duvet, and then remove and wash the duvet cover between guests. In some hotels, the system used comprises two bed sheets, wherein one sheet is placed below the duvet, and another sheet is placed on top of the duvet, and the sheets are folded over the top of the duvet. This method has the advantage of being very efficient. It is easy to strip the bed, remove the sheets from the top and bottom of the duvet, and replace them with clean sheets. However, this method has the disadvantage of not securely retaining the duvet inside the sheets while guests are in the bed. The bed sheets are simply folded over the duvet at the top of the bed; they are not secured in place. Often, while guests are sleeping, the bed sheets will separate from the duvet, exposing the duvet to the guests, and defeating the purpose of enclosing the duvet in bed sheets.

Other methods comprise using covers that securely enclose the duvet, thereby retaining the duvet inside the enclosed cover. The duvet covers are secured using means such as zippers, buttons, snaps, a hook and loop system, and the like. These systems will almost certainly prevent exposure of the duvet. But these systems are not practical when a hotel has multiple beds to change. There is inefficiency, because it takes quite a bit of time to undo the zipper or other means for securing the duvet cover, remove the duvet from the cover, place the duvet in a clean cover, secure the duvet inside the clean cover, and place the duvet and cover onto the bed.

The present invention solves these problems by providing methods and devices for securely enclosing a duvet inside a cover, while at the same time allowing for rapid and efficient changing of the duvet cover.

SUMMARY

The invention comprises devices and methods that allow for rapid and efficient changing of duvet covers while securely enclosing and isolating a duvet when the duvet is in use. In a preferred embodiment, the invention comprises two sections of material that are sized to be larger than the duvet. The two sections of material are secured together along one edge only, and the secured edge is placed at or near the head of the bed. The side and bottom edges are free, and are not secured together.

To make the bed, the duvet cover is placed on the bed in geometric alignment with the bed and with the secured edge at or near the head of the bed. The duvet is placed between the two sections of material, thereby isolating the duvet completely inside the material. This prevents the duvet from becoming exposed while guests are using the bed, and simultaneously allows for easy and rapid changing of the duvet cover after use.

In another embodiment, a single piece of material is sized to be wider than the width of the duvet and sized to be longer than twice the length of the duvet. The single piece of material is folded along a midline, and the duvet is placed between the folded material, thereby isolating the duvet.

In another embodiment, the duvet cover may be secured along one edge that is placed at or near the head of the bed and along a small portion of each side edge, creating a small pocket in which to slip the duvet.

The present invention is described using the following examples, which may describe more than one relevant embodiment falling within the scope of the present invention.

DETAILED DESCRIPTION

Figure 1:
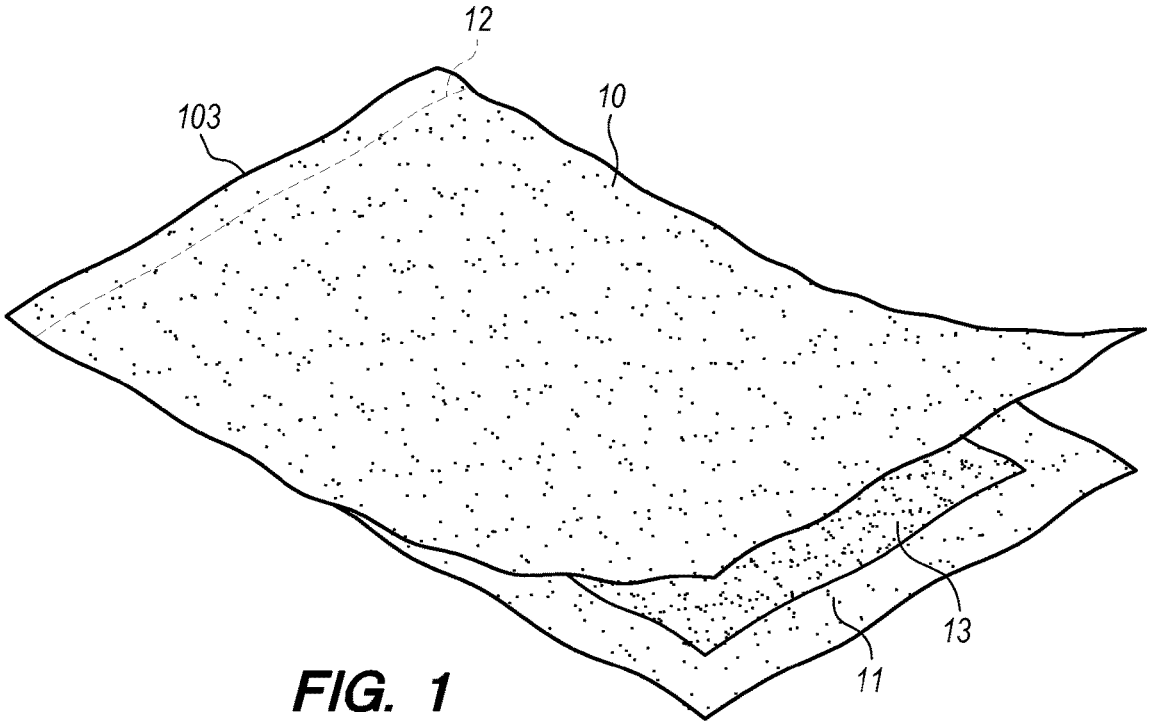
FIG. 1 is a perspective view of an embodiment of the invention, with the upper section raised to expose the duvet.

In one embodiment of the invention, as shown in FIG. 1, two sections of material are used, a first upper section 10 and a second lower section 11. The material may be made from any flexible material. Non-limiting examples comprise polyester, cotton, linen, wool, flannel, rayon, modal, blended material, or any other synthetic or natural fabric, textile, or material that is washable, either machine-washable or washable by hand.

Both upper section 10 and lower section 11 are sized to be significantly larger than duvet 13, in both length and width. Duvet 13 may be of any size or shape, and each of the two sections of material is sized so that it is significantly larger than the duvet, as shown in FIG. 1. As used herein, significantly larger means that there is material in each section that extends beyond the edges of the duvet to cover and to sufficiently isolate and enclose duvet 13.

Typically a duvet is longer than it is wide to correspond with the shape of most beds. In other words, a duvet is typically a rectangle with one of the shorter edges placed at the top, or head, of a bed, and the other shorter edge placed at the bottom, or foot, of the bed. FIG. 1 shows this embodiment where the first upper section, second lower section, and duvet are rectangular in shape. It is apparent that the duvet may be of any shape, including but not limited to square or circular, and that the first upper and second lower sections may be shaped and sized to be significantly larger than the duvet.

In some preferred embodiments, upper section 10 and lower section 11 are secured 12 along one edge only. In one embodiment, upper section 10 and lower section 11 are secured 12 together along common edge 103 of a rectangular shape, as shown in FIG. 1. In one embodiment, upper section 10 and lower section 11 are secured 12 using stitching along one of the short edges of the rectangle, common edge 103.

Upper section 10 and lower section 11 may be stitched together, or they may be secured 12 together in using any other methods known in the art, including but not limited to zippers, hook and loop systems, snaps, buttons, or decorative means.

As non-limiting examples, common edge 103 may be secured together using any type of stitching, including but not limited to double stitching, zig-zag stitching, superimposed seams, lapped seams, bound seams, flat seams, or decorative stitching. One example comprising double stitching 12 and 12*a* is shown in FIG. 2.

Figure 3:
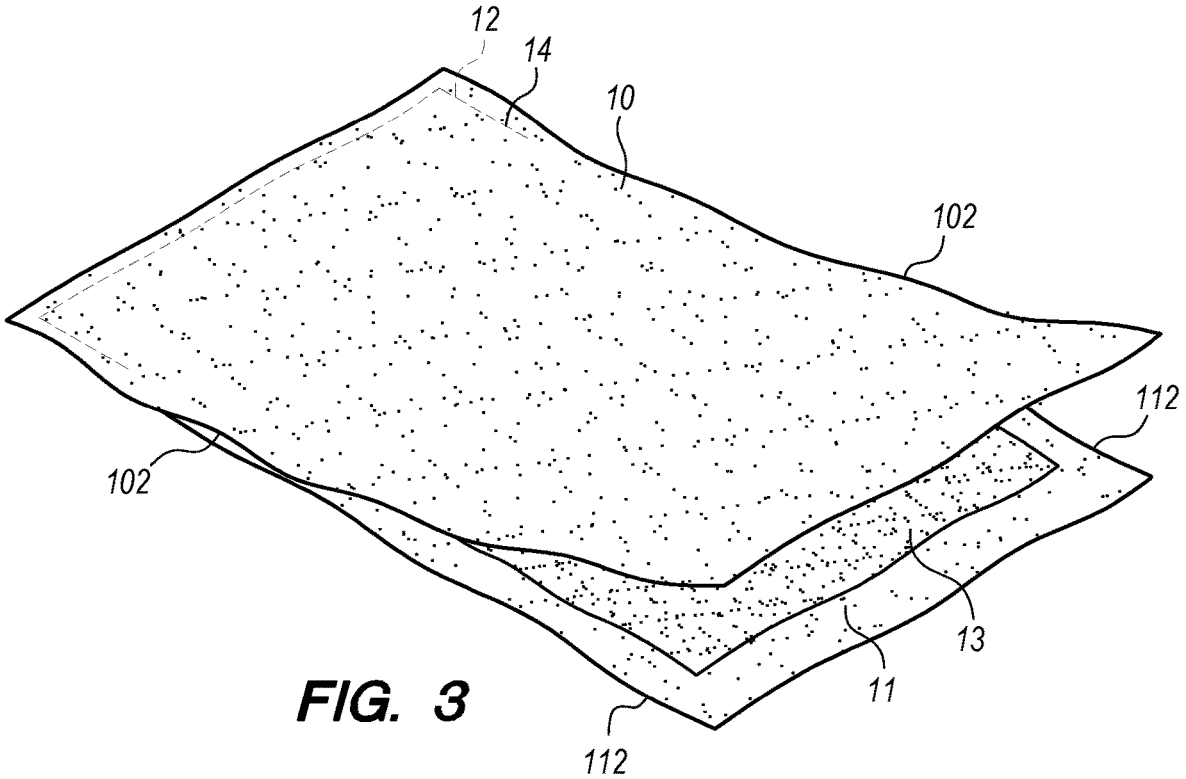
FIG. 3 is a perspective view of another embodiment of the invention, with the upper section raised to expose the duvet.

FIG. 3 shows another embodiment where upper section 10 and lower section 11 are secured 12 along top edge 103, and also secured 14 along a portion of the side edges 112 and 102. This creates a small pocket in which to slip the top edge of duvet 13. Securing means 14 may comprise any of the securing means 12 described above.

Figure 4:
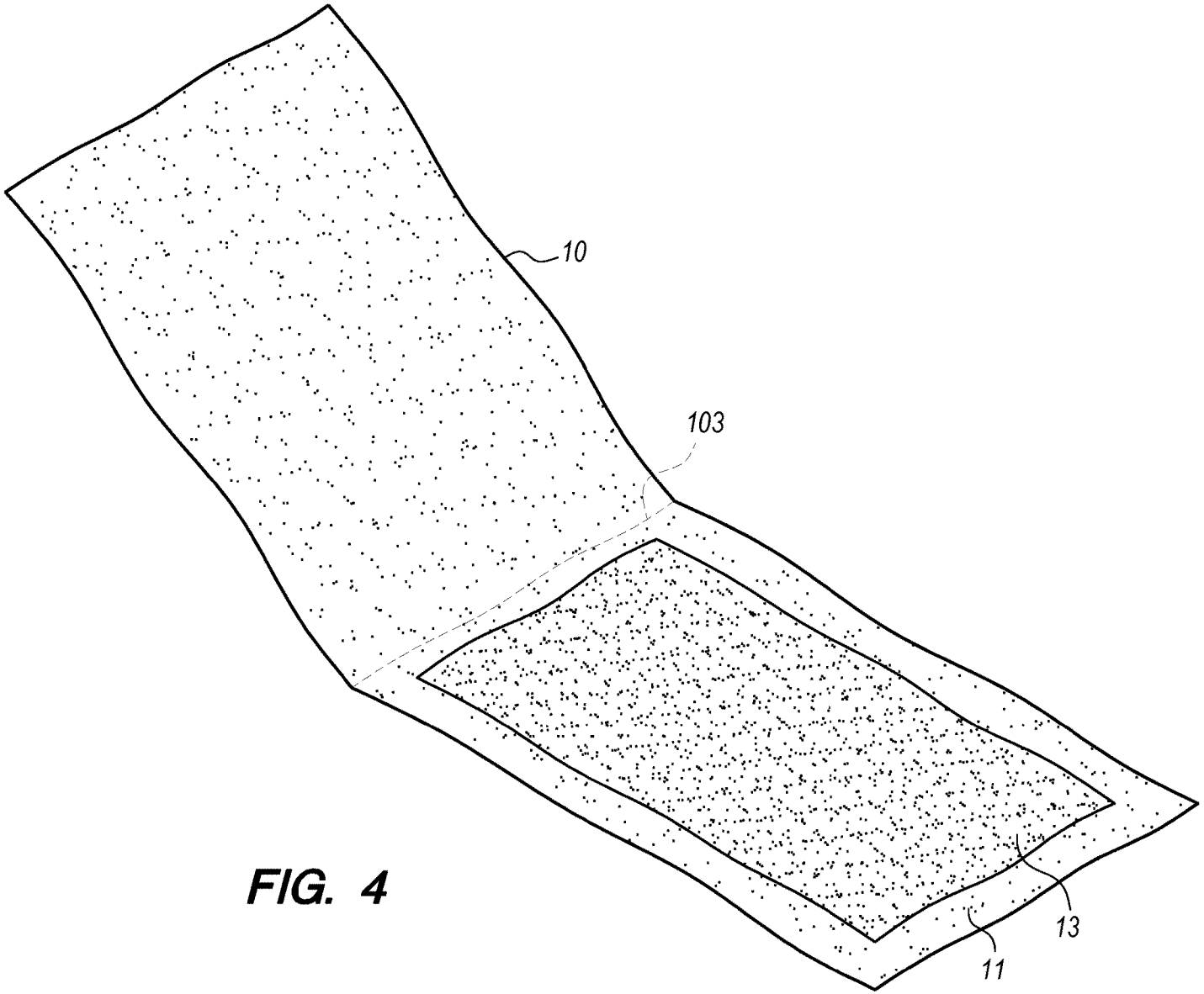
FIG. 4 is a perspective view of another embodiment of the invention, with the upper section raised to expose the duvet.

FIG. 4 shows another embodiment using a single piece of material. In this embodiment, the material is significantly wider than the width of the duvet, and is significantly longer than twice the length of the duvet, with lower section 11 and upper section 10 comprising one piece of material. To use this embodiment, the securing means 12 comprise the warp and weft of the fabric, which is folded along common edge 103 to form upper section 10 and lower section 11. In this embodiment, common edge 103 also forms midline 103, and may be marked by a fabric fold-line, stitching, print on the fabric, small cut-outs, colored fabric, colored threads, or other means of indicating a line in fabric.

Figure 2:
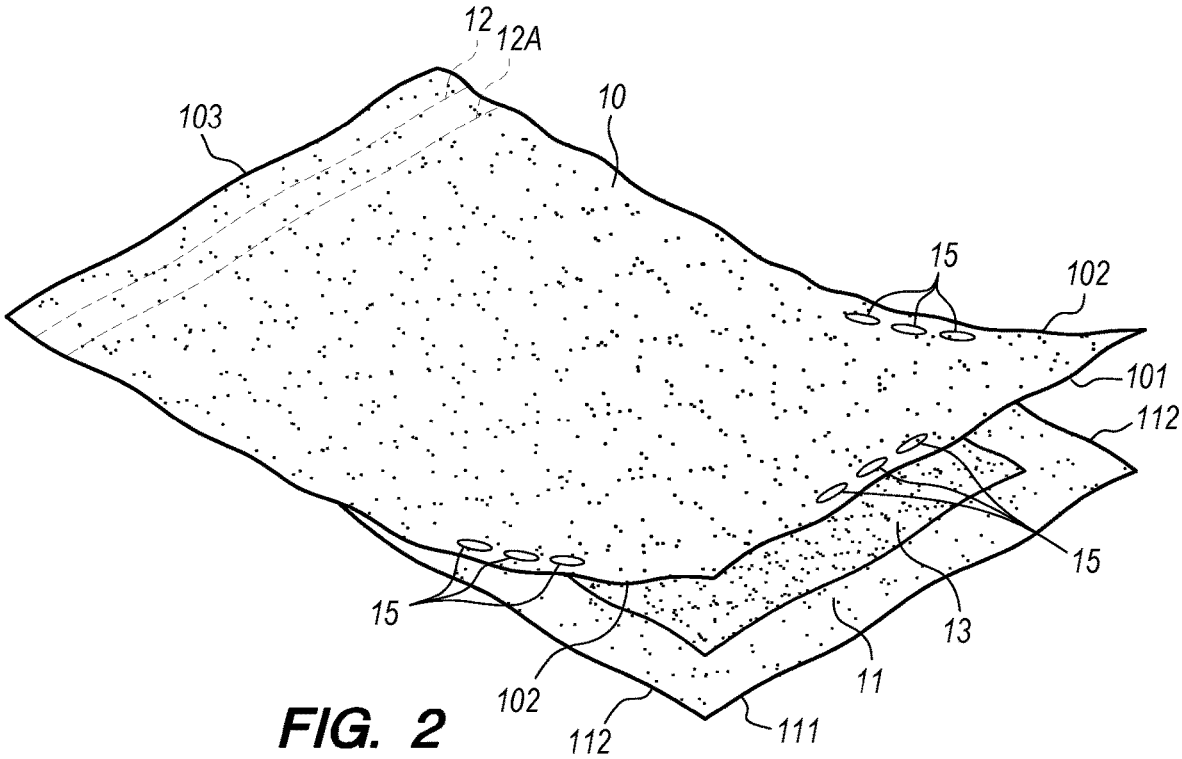
FIG. 2 is a perspective view of another embodiment of the invention, with the upper section raised to expose the duvet.

In some embodiments, the edges of one or both of the sections of material may have weighted elements 15 to weigh down the free edges of the duvet cover, further ensuring that the duvet is isolated and covered, as shown in FIG. 2.

Weighted elements 15 may comprise decorative stitching, small weights, or other features that add weight to the material. In other embodiments, weighted elements 15 may comprise material that is doubled, tripled or otherwise folded to give weight at the free edges. In these embodiments, for example, each side edge 102 may be folded one or more times, and secured together by stitching or any other securing means 12. This creates multiple layers of fabric, adding weight to the free edges.

Weighted elements 15 may be strategically disposed along the free edges of upper section 10, wherein the free edges comprise side edges 102, bottom edge 101, or any combination thereof. In a similar manner, weighted elements 15 may be strategically disposed along the free edges of lower section 11, wherein the free edges comprise side edges 112, bottom edge 111, or any combination thereof.

Figure 5:
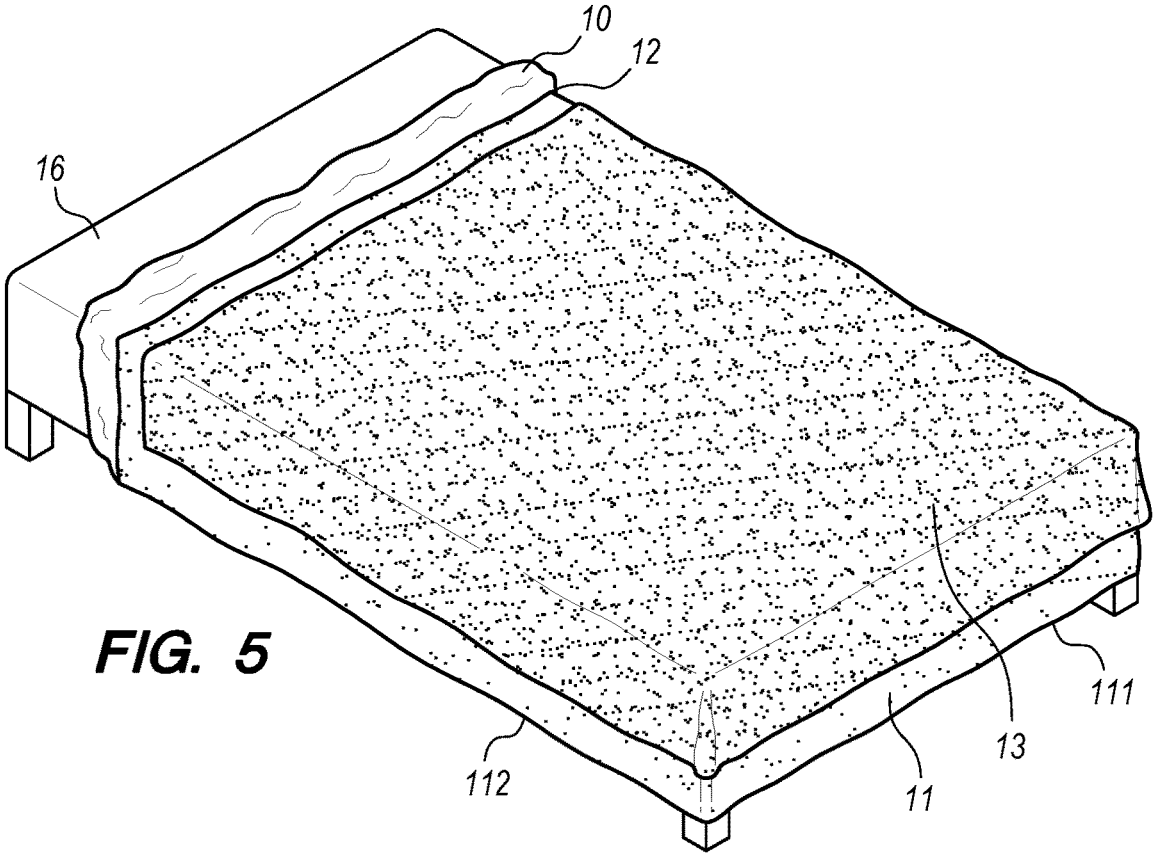
FIG. 5 is a perspective view of an embodiment of a step in a method of using the invention.

The invention may be used to quickly and efficiently make and unmake a bed. In one embodiment, lower section 11 is placed on top of a bed 16, as shown in FIG. 5. Typically, bed 16 has a fitted sheet and flat sheet over a mattress.

Figure 6:
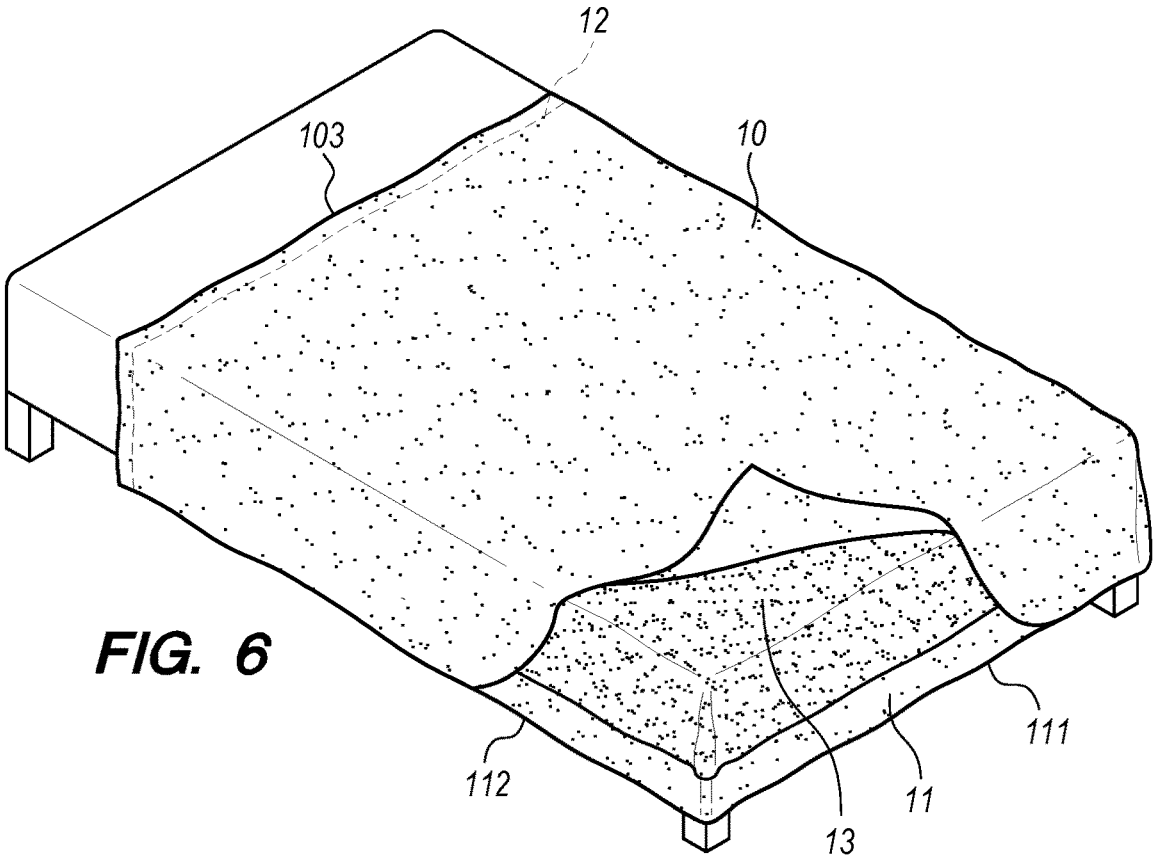
FIG. 6 is a perspective view of an embodiment of a step in a method of using the invention.

Lower section 11 is centrally positioned in substantial geometric alignment over bed 16 with edges 112 and 111 hanging down the sides of the bed. Common edge 103 is positioned at or near the head of the bed, as shown in FIG. 6. Upper section 10 is pulled, folded, or rolled back along common edge 103, exposing a top surface of lower section 11. In some embodiments, as shown in FIG. 5, upper section 10 is pulled back to and folded along securing means 12.

Duvet 13 is centrally positioned, in substantial geometric alignment, adjacent to the top surface of lower section 11 and bed 16, as seen in FIG. 5. The top edge of the duvet is positioned at or near common edge 103. Once duvet 13 is in place, upper section 10 is pulled, unfolded, or unrolled, and positioned on top of duvet 13, with the bottom surface of section 10 adjacent to duvet 13. FIG. 6 shows upper section 10 partially unfolded on top of and adjacent to duvet 13. When upper section 10 is fully unfolded and extended, the entire duvet 13 is enclosed and isolated inside the duvet cover, and on top of bed 16.

To unmake the bed, the duvet cover and duvet are removed from the mattress by any means known in the art. The duvet is removed from inside the duvet cover. A clean duvet cover is positioned on bed 16 as described above, by centering lower section 11 in substantial geometric alignment on top of bed 16 with common edge 103 positioned at or near the head of the bed. The process described herein is repeated to position duvet 13 between and adjacent to upper section 10 and lower section 11, thereby isolating duvet 13 from the exterior. This process is repeated as often as needed.

A similar method is used to make a bed using the embodiment shown in FIG. 3. Lower section 11 is centrally positioned in substantial geometric alignment on top of mattress 16, with edge 103 at the top of the bed. Upper section 10 is pulled or folded back, although it cannot be entirely folded back due to stitching 14 that runs along, and secures, a portion of side edges 112 and 102. Upper section 10 is pulled back as far as stitching 14 will allow. Duvet 13 is positioned in substantial geometric alignment with the duvet cover and adjacent to the top surface of lower section 11 by slipping the edge of duvet 13 into the small pocket created by securing means 14 and securing means 12. Once duvet 13 is in place, upper section 10 is pulled, unfolded, or unrolled, and positioned on top of duvet 13 so that the bottom surface of upper section 10 is adjacent to the duvet.

To unmake the bed, the duvet cover and duvet are removed from the mattress by any means known in the art. The duvet is removed from inside the duvet cover. A clean duvet cover is positioned on bed 16 as described above, by centering lower section 11 on bed 16 with common edge 103 positioned near the head of the bed. The process described herein is repeated to enclose and isolate duvet 13 between and adjacent to upper section 10 and lower section 11. This process is repeated as often as needed.

A similar method is used to make and unmake a bed using the embodiment shown in FIG. 4. To use this embodiment, the duvet cover is centrally positioned on bed 16 with lower section 11 of the material laid on top of the mattress and sheets. Lower section 11 is in substantial geometric alignment with bed 16. Midline 103 is positioned at or near the head of the bed. Upper section 10 of the material is pulled, folded, or rolled back at or near midline 103 exposing the top surface of lower section 11. Duvet 13 is placed in substantial geometric alignment on top of and adjacent to the exposed top surface of section 11. The other half of the material, section 10, is pulled, unfolded or unrolled over the top of, and adjacent to, duvet 13, enclosing and isolating duvet 13, thereby sandwiching duvet 13 in between upper section 10 and lower section 11.

To unmake the bed using this embodiment the duvet cover and duvet are removed from bed 16 by any means known in the art. Duvet 13 is removed from the duvet cover. A clean duvet cover is positioned on bed 16 as described above, by centering lower section 11 in substantial geometric alignment on bed 16 with midline 103 positioned at or near the head of bed 16. The process described herein is repeated to enclose and isolate duvet 13 between upper section 10 and lower section 11. This process is repeated as often as needed.

CONCLUSIONS, OTHER EMBODIMENTS, AND SCOPE OF INVENTION

The above description presents the best mode, and preferred embodiments contemplated in carrying out the invention. However, it will be apparent to one with skill in the art that the invention described herein may be provided using some or all of the mentioned features and components without departing from the spirit and scope of the present invention. It will also be apparent to the skilled artisan that the embodiments described above are specific examples of an inventive concept, which may have greater scope than any of the singular descriptions taught. There may be many alterations made in the descriptions without departing from the spirit and scope of the present invention.

What is claimed is:

1. A duvet cover comprising:

a first upper section of material having an overall width dimension and an overall length dimension larger than the overall width and length dimensions of a duvet to be covered;

a second lower section of material having an overall width dimension and an overall length dimension larger than the overall width and length dimensions of the duvet to be covered, wherein the second lower section of material is sewn to or secured to the first upper section of material along only one common edge of the first and second sections laid one over the other, leaving a free edge extending along at least a portion of two side edges and along a bottom edge of the first and second sections, the bottom edge being both distal from and parallel to the common edge;

stitching or securing means extending parallel to the overall width dimension of the first and second sections, said stitching or securing means further being spaced apart from the common edge of the first and second sections; and wherein the first and second sections of material are configured to be secured together only along the common edge via said stitching or securing means and not secured together along the portion of the side edges and the bottom edge; and wherein the duvet cover further comprises weighted elements disposed along the side and bottom free edges thereof, the weighted elements functioning to weigh the duvet cover down over the side edges and bottom edge of a bed; and wherein the weighted elements are sewn into the fabric or otherwise attached to the fabric.

2. The duvet cover of claim 1, fabricated from a washable fabric including but not limited to polyester, cotton, linen, wool, flannel, rayon, modal, blended fabrics, or similar synthetic or natural materials.

3. The duvet cover of claim 1, wherein the second section of material is secured to the first section of material by a snap, zipper, hook and loop system, button, decorative stitching, double stitching, or similar attachment mechanisms, or a combination thereof.

* * * * *